United States Patent [19]

Brull

[11] Patent Number: 4,575,267

[45] Date of Patent: Mar. 11, 1986

[54] RECORD MEDIA THICKNESS COMPENSATING MECHANISM

[75] Inventor: Robert A. Brull, Dryden, N.Y.

[73] Assignee: NCR Corporation, Dayton, Ohio

[21] Appl. No.: 602,800

[22] Filed: Apr. 23, 1984

[51] Int. Cl.[4] ..... B41J 11/08; B41J 11/20

[52] U.S. Cl. ..... 400/56; 400/58; 400/649; 400/655; 400/656

[58] Field of Search ..... 400/56-60, 400/649, 654, 655, 656, 659

[56] References Cited

U.S. PATENT DOCUMENTS

| | | | |
|---|---|---|---|
| 3,868,008 | 2/1975 | Brumbaugh | 400/649 |
| 3,912,068 | 10/1975 | Kwan et al. | 400/595 |
| 4,143,977 | 3/1979 | Kurihara et al. | 400/56 |
| 4,145,146 | 3/1979 | Ohkawara et al. | 400/605 |
| 4,184,780 | 1/1980 | Kurihara et al. | 400/56 |
| 4,210,076 | 7/1980 | Yamamoto et al. | 400/59 |
| 4,422,782 | 12/1983 | Lawter et al. | 400/56 |

OTHER PUBLICATIONS

Anderson, "Automatic Adjusting . . . Station", IBM Technical Disclosure Bulletin, vol. 24, No. 11B, pp. 6158-6159, 4/81.

*Primary Examiner*—William Pieprz

*Attorney, Agent, or Firm*—Wilbert Hawk, Jr.; George J. Muckenthaler

[57] ABSTRACT

A mechanism for compensating for different thicknesses of record media at a printing station utilizes a platen supporting or carrying assembly which is pivotable to move the platen toward the print head. A first cam member is rotated to engage with and to swing the platen supporting assembly into printing position and a second cam member is connected with the first cam member and rotated thereby to maintain the assembly in printing position.

20 Claims, 6 Drawing Figures

RECORD MEDIA THICKNESS COMPENSATING MECHANISM

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical derived system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and journal printing operation, the print head structure may be a multiple element type and horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form or media while the carriage and print head are moved above and across the form or media in the horizontal direction.

Alternatively, the print head may be supported and guided along a line of printing wherein the form or record media is placed on edge and the print head is caused to be driven in a vertical direction for the printing operation.

Further, the printer structure may be an arrangement which includes a plurality of equally-spaced, horizontally-aligned, single element print heads which are caused to be moved in back and forth manner to print successive lines of dots in making up the lines of characters. In this latter arrangement, the drive elements or transducers are individually supported along a line of printing. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the case of a wire matrix printer which is utilized for form or multi-copy printing, the difference in thickness of the forms or copies may require some means or mechanism for adjusting the gap or the distance between the print head and the printer platen. It is in the field of business forms or like record media of different thicknesses that the subject matter of the present invention is most closely associated and which provides for improved and advantageous positioning and control of such forms during the printing operation.

Representative documentation in the field of wire matrix print heads used for printing forms or like record media includes U.S. Pat. No. 3,837,461, issued to H. K. Waibel on Sept. 24, 1974, which discloses a platen assembly for feeding and holding single or multi-layer record media wherein the platen and the pressure roller are spring urged into engagement with the form by a pressure arm or block and the form is urged against gap guide means in the form of gap shoes on each side of the print head, and the form is held by the platen and the pressure and feed rollers during the printing operation.

U.S. Pat. No. 3,912,068, issued to O. Kwan et al. on Oct. 14, 1975, discloses a printer having a document thickness compensating device wherein the spring-mounted platen is moved into position to clamp the document with substantially uniform pressure against elongated surfaces, and a document holding assembly includes a slot with control of document movement to position the document for printing.

U.S. Pat. No. 3,935,936, issued to R. H. Wilczewski on Feb. 3, 1966, discloses media thickness compensation means wherein the print head is biased in selective manner against a multi-faced rotatable stop member associated with a print head carried roller.

U.S. Pat. No. 4,024,940, issued to W. Hendrischk et al. on May 24, 1977, discloses a matrix printer having a document thickness compensation device wherein a roller on the print head runs on a resilient rail urged against the platen and the roller can be retracted by pivoting the rail carrier under engagement of a second rail cooperating with a second roller or the head.

U.S. Pat. No. 4,056,183, issued to J. Beery on Nov. 1, 1977, discloses a platen and a feed control roller shiftable by a solenoid between a retracted position and a print position.

U.S. Pat. No. 4,184,780, issued to T. Kurihara et al. on Jan. 22, 1980, discloses a printer having a platen with separate units movable toward and away from the recording medium by rotary cams and spring means and lockable in position by lever means.

U.S. Pat. No. 4,222,673, issued to M. G. Plaza et al. on Sept. 16, 1980, discloses a print head carriage having a rotatable manifold member operating in eccentric camming manner to adjust the distance between the print head and the platen for accommodating printing media of various thicknesses.

U.S. Pat. No. 4,227,819, issued to R. F. Manriquez on Oct. 14, 1980, discloses a platen assembly for feeding and holding single or multi-layer record media and having one of a pair of feed rollers pivotally mounted to yieldingly engage and hold both sides of the record media while the platen yieldingly engages and holds the record media against gap determining guides. The platen is free floating with the aid of a pair of coil springs and is raised into engagement with the record media by rotatable cam means.

U.S. Pat. No. 4,233,895, issued to H. Wehler on Nov. 18, 1980, discloses a print head which is adjustable relative to the record media by means of complementary cam members and spring-urged cam followers operably associated with an electric motor.

U.S. Pat. No. 4,390,292, issued to H. M. Krenz on June 28, 1983, discloses bracket adjusting means for moving the print head relative to the platen for print media of different thicknesses.

And, U.S. Pat. No. 4,439,051, issued to R. L. Lawter on Mar. 27, 1984, discloses a rotatable platen carried on a pivoted arm and including solenoid means with spring loading for multi-form documents.

SUMMARY OF THE INVENTION

The present invention relates generally to impact type printers which have the capability of printing on record media of different thicknesses. More particularly, the present invention relates to means for positioning the printer platen and an associated media drive roller in a manner to compensate for the difference in thickness of several types of record media being used in the printer. The record media may be a single layer sheet or a variety of multilayer forms, any of which may be of different or greater thickness from other media.

A media thickness compensating assembly is pivoted from a predetermined position relative to the printing station for supporting the printer platen and the media drive roller so as to enable moving the platen and the roller in a direction to and from the print head. A solenoid-operated cam line, operably associated with and forming a part of the compensating assembly, is caused to be rotated in one direction to allow insertion of the form or like media in the gap between the platen and the print head, and the cam line is then caused to be rotated in the other direction to position the platen and the form for printing operation.

A second cam line is operably associated and connected with the solenoid-operated cam line wherein the second cam line is rotated to hold the platen and the form in position during the printing operation. The platen is resiliently supported and the second cam line includes over-centering means engageable with for retaining and holding the platen in printing position.

In view of the above discussion, the principal object of the present invention is to provide mechanism in a printer for compensating different thickness record media.

Another object of the present invention is to provide camming means rotatable in a manner to enable insertion of record media of different thickness.

An additional object of the present invention is to provide mechanism for adjusting the gap for record media inserted between the platen and the print head.

A further object of the present invention is to provide a first camming means rotatable to accommodate record media of different thicknesses at a printing station and second camming means for holding the record media in position during printing operation.

Additional advantages and features of the present invention will become apparent and fully understood from a reading of the following description taken together with the annexed drawing.

DESCRIPTION OF THE PREFERRED EMBODIMENT

Prior to describing the structure in detail, it should be noted that the printer, for use in certain operations and/or environments, may be termed a vertical printer in that the paper or like record media is directed from a roll and assumes an upright position on its edge as the paper travels or is transported past the printing station. The paper drive roller and the platen are vertically positioned and supported, and the print element or print head moves up and down adjacent and along the platen.

Figure 1:
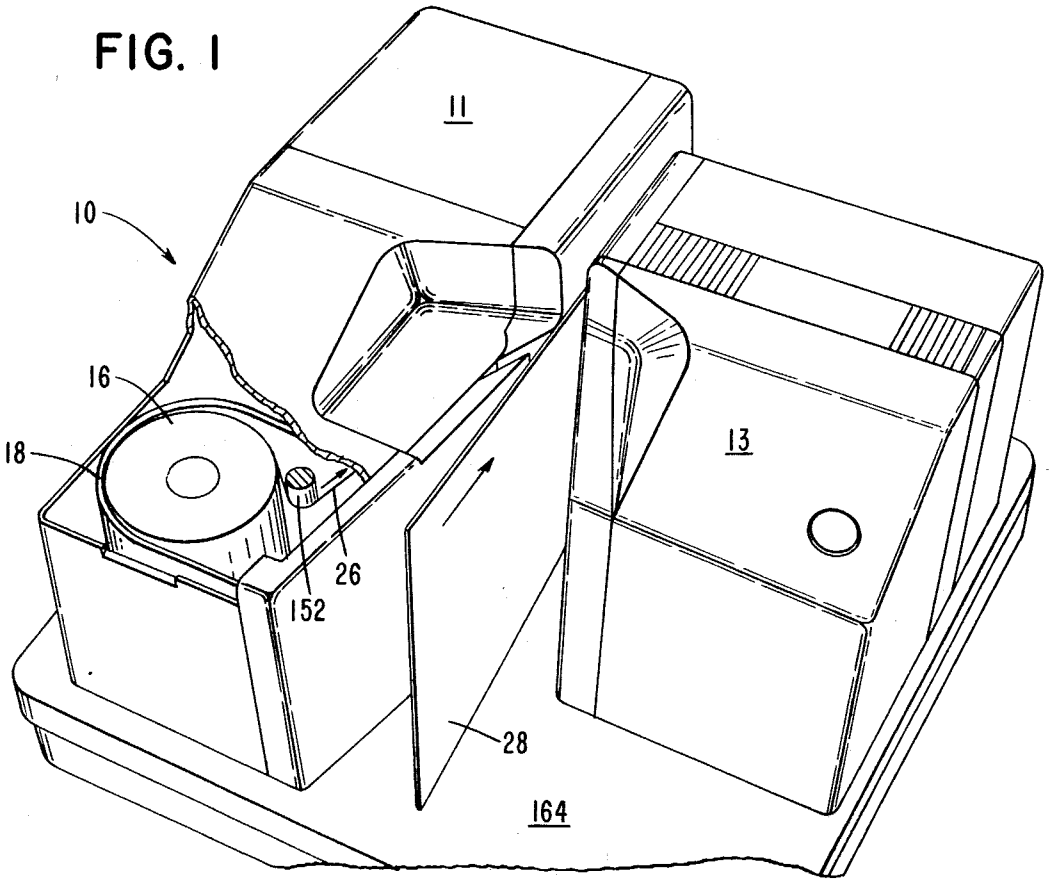
FIG. 1 is a perspective view of a printer incorporating the subject matter of the present invention.

Referring now to FIG. 1, there is shown a perspective view of a printer, generally designated as 10 and oriented for operation in vertical manner, wherein record media either in the nature of paper 26 supplied from a roll 16, exposed by cutting away a portion of the top of one of the printer enclosures, or a business form 28 entering in a direction between two enclosures 11 and 13, is supported on edge for the printing operation. While the printer 10 of FIGS. 1 and 2 is illustrated for vertical printing operation it is understood, of course, that the subject matter of the present invention may likewise be utilized in a horizontal arrangement, wherein the paper 26 is horizontal as supplied from the paper roll 16 and the business form 28 is placed in like orientation for printing thereon, as may be later shown and described.

Figure 2:
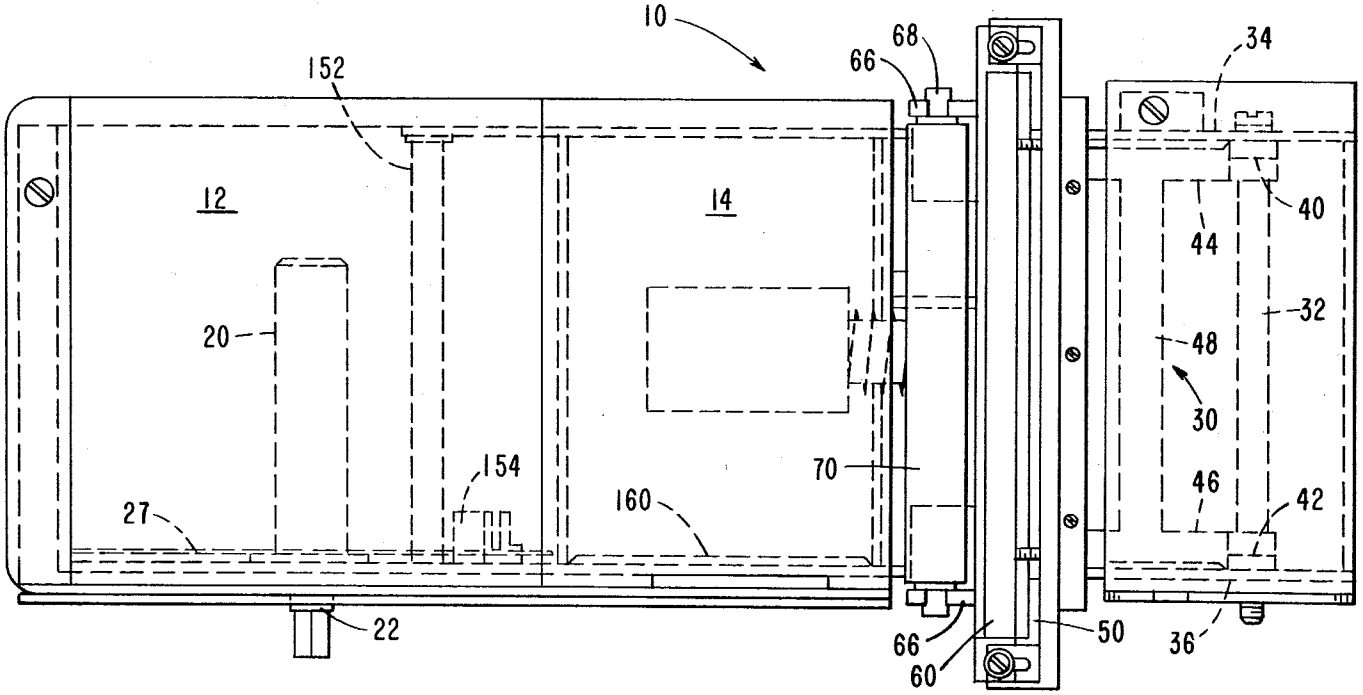
FIG. 2 is a front view of certain mechanism within the printer enclosure of FIG. 1.
Figure 3:
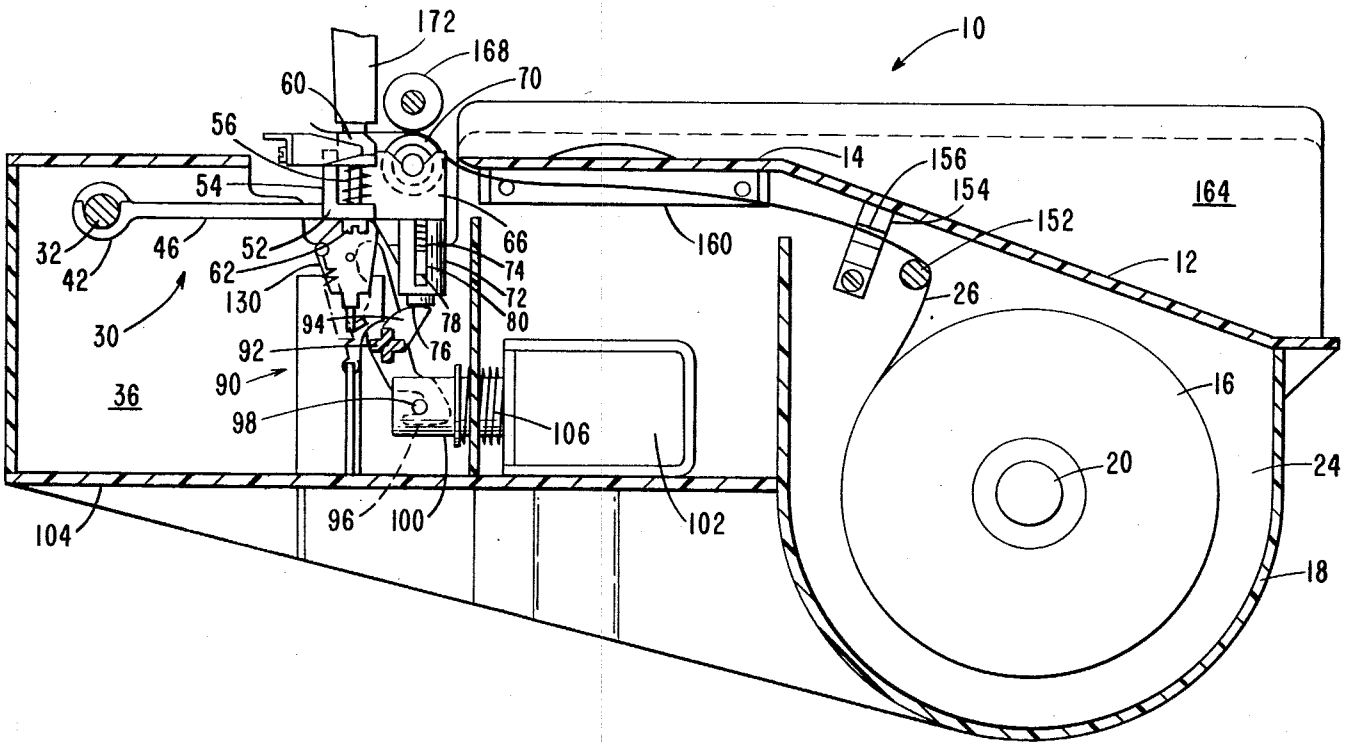
FIG. 3 is a top plan view showing the arrangement of certain mechanism of the printer.

Referring now to FIGS. 2 and 3, FIG. 2 looking in the direction from the right side in FIG. 1 and FIG. 3 looking in the direction from the left side in FIG. 1, a frame member having a first or angled portion 12, as best seen in FIG. 3, is connected with a second portion 14 wherein the first portion provides a wall at one side of the paper roll 16 and the second portion provides a guide or support structure adjacent the printing station. The frame of the printer includes a curved well 18 (FIG. 3) formed to enclose the paper roll 16 which is carried by a hub or spindle 20 supported in a bearing 22 (FIG. 2) in the floor 24 of the curved well, which is a part of the main frame and formed therewith to contain and guide or direct the paper 26 from the roll 16. A round plate 27 is placed on the bearing 22 for supporting the paper roll 16. It is noted at the outset that the main frame structure is made of plastic which may be of clear material and may be molded in one piece. As an example, the frame member portions 12 and 14 are molded in one piece and may be removable for access to certain of the interior parts of the printer.

The printing station includes a compensating assembly wherein a support structure or member 30 (see also FIGS. 4 and 5) in the nature of a forms-compensating arm is pivotable on a forms-compensating arm shaft 32 (FIG. 3) journaled in the top portion 34 and in the bottom portion 36 of the frame (FIG. 2). The support member 30 is preferably molded in a single piece and includes bearing portions 40 and 42 forming journals for the shaft 32 and integral with extension arms 44 and 46 which have a connecting bar 48 therebetween. The support member 30 includes a second bar 50 connecting the ends of the extension arms 44 and 46 and assumes a shape in the form of a right angle having two legs 52 and 54. The leg 52 of bar 50 is in the same plane as the extension arms 44 and 46, and also in the same plane as but longer than the connecting bar 48. The leg 54 of bar 50, as seen in FIG. 3, extends normal from the plane of arm 46 and leg 52 and is the same length as leg 52. A pair of coil springs, as at 56, are placed against one surface of the leg 52, one spring at each end thereof, and resiliently support a flat metal platen 60 by means of associated screws, as at 62, inserted through the leg 50 and the spring 56 and threaded into the platen.

The support member 30 further includes flat, generally square portions, as at 66, which extend normal to the leg 52 of bar 50 and are formed in bifurcated manner to provide bearings for the ends of a shaft 68 carrying a pressure roller 70 which aids in driving the record media. A pair of cylindrically-shaped members, as at 72, are formed integral with the leg 52 inwardly of the bifurcated portions 66 (see FIG. 6) and extending oppositely thereof. Each of the members 72 contains a spring 74 therein biasing a pin or plunger 76 (FIG. 5) by means of a shoulder 78 riding in a slot 80 in the wall of the cylindrical member 72. The entire forms-compensating arm assembly swings about the shaft 32.

Figure 5:
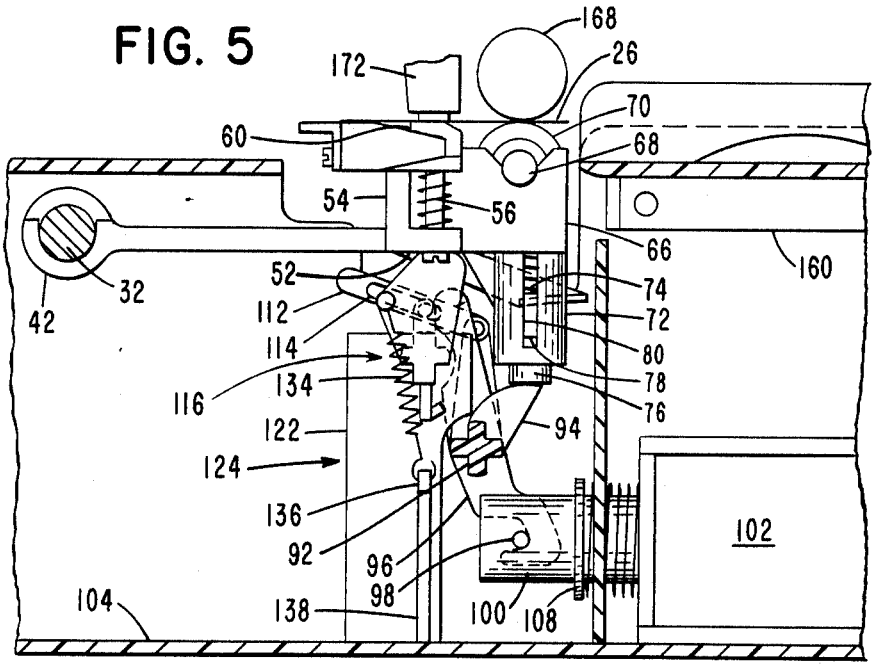
FIG. 5 is a similar view and illustrating a printing position of the parts.
Figure 6:
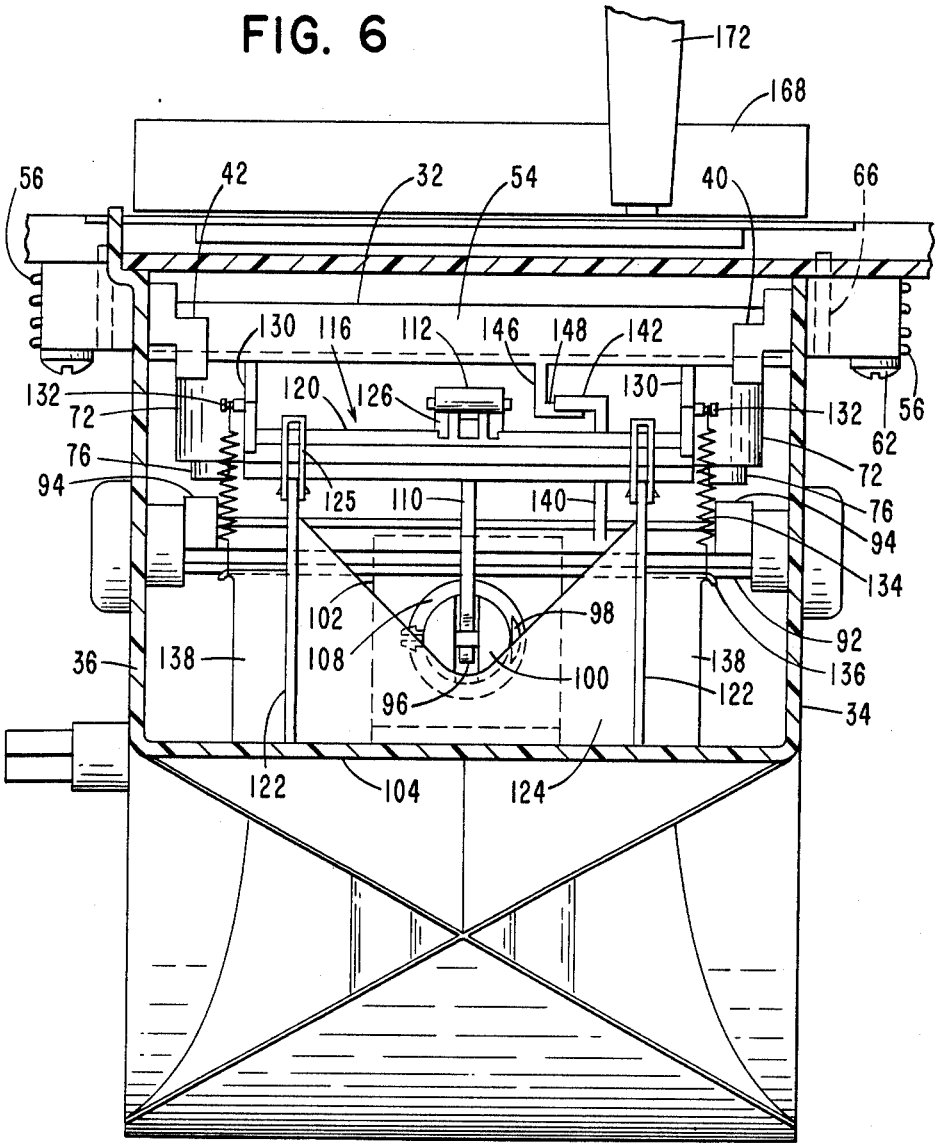
FIG. 6 is a view taken from the left side of FIG. 3 with the printer oriented normal thereto for use in a horizontal printing arrangement.

A forms-compensating cam shaft assembly, generally designated as 90, (FIGS. 3 and 4) is operably associated with the forms-compensating arm assembly 30 and includes an irregular or X-shaped shaft 92 journaled at the ends thereof in the frame portions 34 and 36 (FIG. 6). The shaft 92 includes a pair of generally triangular-shaped projections, as at 94, (FIG. 5) which are positioned to engage with the spring-urged pins or plungers 76 captured within the cylindrical members 72. A centrally-located hook-like member 96 (FIG. 6) of the shaft 92 is connected with a pin 98 carried by an armature or plunger 100 of a solenoid 102 secured to a side frame portion 104 (FIGS. 3, 4 and 5) connecting the frame portions 34 and 36. The solenoid armature is loaded in one direction of travel by a coil spring 106 operating against a washer 108.

A second centrally-located member 110 (FIG. 6) formed directly opposite the hook member 96 on shaft 92 is pivotally connected to a link 112 having slots as at 114 (FIG. 5) in the sides thereof for slidably connecting with a second cam assembly, generally designated as 116. The assembly 116 includes an irregular or X-shaped shaft 120 which is journaled in the outer portion of flat, generally rectangular shaped arms, as at 122, of a cradle 124 (FIG. 6) extending from the frame member 104. Each of the arms 122 has a generally U-shaped element 125 over the end portion for capturing and retaining the shaft 120 (FIG. 6). The shaft 120 has a double-sided member 126 as an integral portion thereof with ears slidable in a lost motion-type connection with the slots 114 in the link 112. The shaft 120 also includes at each end thereof a multi-sided plate-like member 130 as an integral part thereof and extending generally toward the leg 52 of the angle 50 portion of the support structure or member 30. Each of the members 130 has a small projection, as at 132, extending outwardly beyond the ends of the shaft 120 and a coil spring 134 is connected to such projection and to an associated hook 136 on an extending portion 138 on the side of the respective arm 122 of the cradle 124. The X-shaped shaft 92 also includes an arm member 140 extending outwardly therefrom in a direction substantially with the link-connecting member 110 and has a projection 142 normal to the arm member (FIG. 6). The leg 52 of the angle bar member 50 connecting the ends of the extension arms 44 and 46 includes a similar arm member 146 extending outwardly from such leg between the cylindrical members 72 and has a projection 148 normal to such arm member for engagement with the projection 142 of arm member 140 in certain positions of the forms-compensating arm assembly 30 relative to the position of the shaft 92.

Further, in the description of the forms-compensating mechanism and as best illustrated in the top plan view of FIG. 3, the paper 26 is unwound from the paper roll 16 and is directed or trained in a path by a guide shaft 152 toward the printing station. An optical sensor 154 is secured to the floor 24 of the paper roller well 18 and one edge of the paper 26 travels through a slot 156 in the sensor for detecting presence of the paper. A wear bar 160 is secured to the floor 24 on the inside of the printer frame and extends substantially from the sensor 154 to the pressure roller 70 for supporting the edge of the paper 26 in the path as it travels from the guide shaft 152 and through the slot 156 of the sensor 154 toward the printing station.

In the case of a business form or slip 28 (FIG. 1) which is inserted into the interstice formed by the two enclosures 11 and 13 of the printer and into the printing station, the frame or structure may include an extension or preferably a table 164 for supporting the form or slip on edge as it travels toward such station. A feed roller 168 is suitably supported in fixed position within the enclosure 13 and adjacent the pressure roller 70 (FIG. 3) and operable therewith for advancing the paper 26, or a form of slip 28, past the print head 172 (also within the enclosure 13) and the platen 60. It is seen, of course, that the structure of FIG. 3, less the drive roller 168 and the print head 172, is contained within the enclosure 11 and further that the two enclosures 11 and 13 are positioned on the table 164.

Figure 4:
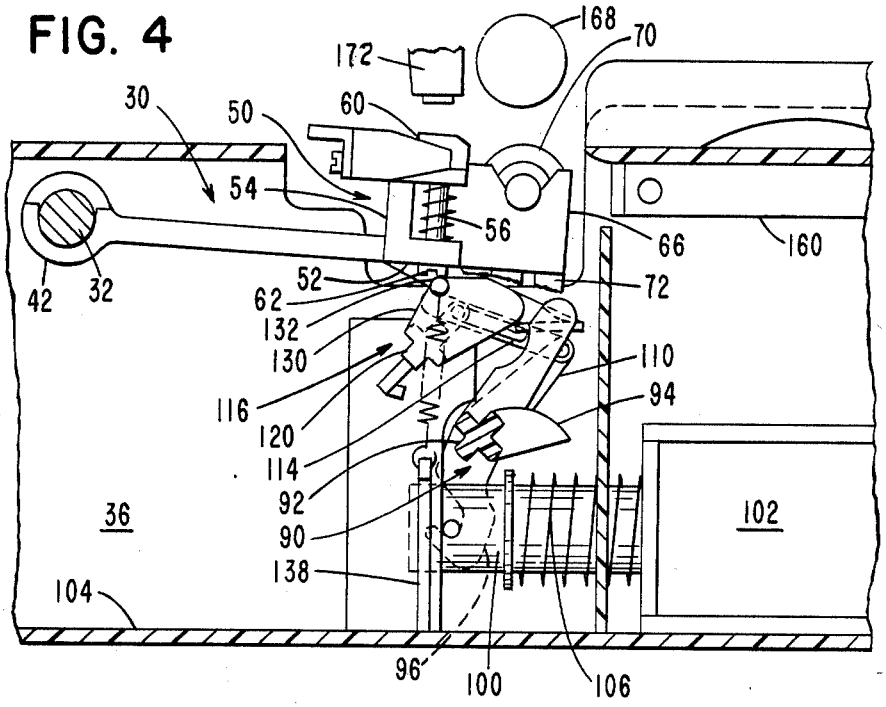
FIG. 4 is an enlarged view of a portion of the printer mechanism shown in FIG. 3 and illustrating a non-printing position and certain parts.

In the operation of the forms-compensating mechanism of the present invention, it is desirable that the mechanism accommodate record media of different thickness and also provide a firm support for the media during the printing operation. FIG. 4 illustrates the position of the forms-compensating arm assembly 30 in preparation for receiving and insertion of a form, as 28, during non-printing, and FIG. 5 illustrates the position of the assembly during a printing operation.

In FIG. 4 the armature or plunger 100 is outward from the solenoid 102 in a de-energized condition thereof or towards the left and the shaft 92 is rotated in a clockwise direction by reason of the armature engaging the hook-like member 96 which moves the projections 94 clockwise and allows the pins 76 freedom of movement therefrom and permits swinging of the forms-compensating arm assembly in such clockwise direction to provide clearance between the pressure roll 70 and the feed roll 168 and also between the platen 60 and the tip of the print head 172 for entry of the record media. While the initial gap (shown exaggerated in FIG. 4) between the platen 60 and the print head 172 is set without any media between the pressure roller 70 and the feed roller 168, the forms-compensating mechanism will automatically maintain the same gap therebetween for different thicknesses of the various media. Depending upon the thickness of the media, the spring-loaded pins or plungers 76 in members 72 are receded to provide or apply the proper loading between the feed roller 168 and the pressure roller 70 for smoothly advancing the media to the printing station.

When the form or other media is in position for printing thereon, the solenoid 102 is energized and the armature or plunger 100 is retracted or moved to the right, as illustrated in FIG. 5. The cam shaft 92 is rotated in the counterclockwise direction and causes engagement of the projections 94 on such shaft with the spring-loaded pins 76 and swings the forms-compensating arm assembly toward the drive roller 168 and the print head 172. The link 112 connecting the first cam shaft 92 and the second cam shaft 120 is moved by the member 110 (FIG. 4) and causes the second cam shaft to be rotated to an over-center position as set and held by the springs 134 (FIG. 5). In this manner, the members 130 (FIG. 6) at the ends of the cam shaft 120 are rotated to tightly engage with the leg 52 (FIG. 5) of the angle member 50 supporting the platen 60 and thusly provide a firm base or support for the printing operation.

As briefly alluded to earlier, FIG. 6 is a view looking at the left side of FIG. 3 and illustrating a horizontal orientation of the forms compensating mechanism. The view shows the pivot shaft 32 along with the cam shaft 92 carrying the projections 94 at the ends thereof for engaging with the pins 76 of the cylindrical members 72 for raising the platen 60 and pressure roller 70 assembly upon energization of the solenoid 102. Further, FIG. 6 shows the second cam shaft 120 with the plate members 130 at the ends thereof for engaging with the underside of the leg 52 of the angle 50 (FIG. 5) supporting the platen 60 and roller 70 assembly, and the springs 134 connecting the members 130 and fixed portions 138 of the arms 122 and operable to maintain the platen and roller assembly in printer operating position.

It is thus seen that herein shown and described is a record media thickness-compensating mechanism which provides first camming means rotatable to accommodate record media and second camming means for providing firm support of the several parts for the printing operation. The mechanism and arrangement enables the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

I claim:

1. Record media thickness compensating mechanism for use in a printer having an operating print head, the mechanism comprising an arm assembly pivotally supported from the printer and carrying a platen opposite the print head, first camming means pivotally supported from the printer and operably associated with the arm assembly, means for rotating the first camming means for moving the platen toward and away from the print head during respective printing and non-printing conditions, second camming means pivotally supported from the printer, and linkage means comprising a lost-motion type connection operably connecting the first camming means and the second camming means whereby the second camming means is rotated by and subsequent to rotation of said first camming means for maintaining the platen in position during printing operation.

2. The mechanism of claim 1 wherein the arm assembly includes means at multiple locations thereof for resiliently supporting the platen.

3. The mechanism of claim 1 wherein the arm assembly includes a plurality of extensions and an angle member connecting the ends of the extensions for supporting the platen.

4. The mechanism of claim 1 wherein the arm assembly includes a plurality of captured members engageable with the first camming means.

5. The mechanism of claim 1 wherein the first camming means includes spaced cam members engageable by the arm assembly.

6. The mechanism of claim 1 wherein the rotating means comprises a solenoid connected with the first camming means and operable for rotation thereby to move the platen toward the print head.

7. The mechanism of claim 1 wherein the linkage means comprises a pin and slot arrangement connecting the first camming means and the second camming means and operable to rotate the second camming means after rotation of the first camming means.

8. The mechanism of claim 1 wherein the second camming means includes spaced cam members for engaging and rotating the arm assembly and maintaining the position thereof during printing operation.

9. The mechanism of claim 1 wherein the first camming means is a shaft having spaced cam portions integral therewith and the arm assembly includes cylindrically-shaped portions integral therewith and which portions include plungers captured therein and engageable with the spaced cam portions on the shaft.

10. A printer having a print head and an opposed platen movable relative to the print head, means for advancing record media past a printing station formed by the print head and the platen, and means for compensating for different thicknesses of record media comprising a support assembly carrying the platen and pivotally connected with the printer, a first cam member journaled from the printer and operably associated with the support assembly, a second cam member operably associated with the first cam member to be rotated thereby, linkage means comprising a lost-motion type connection connecting the first cam member and the second cam member, and means for rotating the first cam member for moving the platen and the record media into position relative to the print head and then rotating the second cam member into engagement with the support assembly for maintaining the position thereof during printing operation.

11. The printer of claim 10 wherein the support assembly includes means for resiliently supporting the platen.

12. The printer of claim 10 wherein the means for advancing the record media comprise a drive roller and a pressure roller, and the support assembly includes an angle member with spaced portions thereon for journaling the pressure roller.

13. The printer of claim 10 wherein the support assembly includes an angle member with spaced cylindrical portions thereon enclosing plunger members engageable with the first cam member.

14. The printer of claim 10 wherein the first cam member includes spaced projections thereon engageable by the support assembly.

15. The printer of claim 10 wherein the first cam member is a shaft having a projection thereon and the second cam member is a shaft having a projection thereon aligned with the first cam member and the linkage means comprises a pin and slot arrangement connecting the projections whereby rotation of the first shaft for moving the platen into position is followed by rotation of the second shaft for maintaining the platen position.

16. The printer of claim 10 wherein said second cam member is a shaft supported and journaled from the printer and includes spaced cam portions and springs connecting the printer and the cam portions for effecting an over-center condition thereof when the second cam member is rotated into position against the support assembly.

17. In a printer having a print head movable along a platen at a line of printing, drive and driven means for advancing record media past the line of printing, a support assembly carrying the platen and pivotable to move the platen toward the print head, the improvement comprising a first cam member journaled in the frame of the printer and rotatable to engage the support assembly for swinging movement thereof, a second cam member journaled for rotation on the printer, and linkage means comprising a lost-motion type connection operably connecting the first cam member and the second cam member whereby rotation of the first cam member moves the platen along with the record media into printing position and then rotation of the second cam member resulting from rotation of said first cam member, maintains the platen and the record media in the printing position.

18. In the printer of claim 17 wherein the support assembly includes spaced cylindrically-shaped projections thereon containing spring-loaded members therein for engaging with the first cam member upon rotation thereof.

19. In the printer of claim 17 wherein the second cam member includes spaced projections thereon and engageable with the support assembly to maintain the platen and the record media in printing position.

20. In the printer of claim 17 wherein the linkage means connecting the first cam member and the second cam member is a pin and slot arrangement whereby the second cam member is rotated after rotation of the first cam member.

* * * * *